United States Patent [19]

Kovacs

[11] 4,393,680

[45] Jul. 19, 1983

[54] METHOD FOR ROLLING RAILS

[75] Inventor: Daniel C. Kovacs, Pittsburgh, Pa.

[73] Assignee: SMS Schloemann-Siemag, Inc., Pittsburgh, Pa.

[21] Appl. No.: 288,413

[22] Filed: Jul. 30, 1981

[51] Int. Cl.[3] ..... B21B 31/08

[52] U.S. Cl. ..... 72/234; 72/221; 72/238; 72/366

[58] Field of Search ..... 72/199, 221, 222, 225, 72/226, 228, 234, 238, 239, 365, 366

[56] References Cited

U.S. PATENT DOCUMENTS 3,342,053 9/1967 Stammbach ..... 72/225
3,802,242 4/1974 Svagr ..... 72/225

OTHER PUBLICATIONS

Dickson, R. W., "Operation and Roll Design of the Gary Rail Mill", Iron and Steel Engineer, Jan. 1953, pp. 93–101.

*Primary Examiner*—Francis S. Husar
*Assistant Examiner*—Jonathon L. Scherer
*Attorney, Agent, or Firm*—Thomas H. Murray; Clifford A. Poff

[57] ABSTRACT

A method for rolling rails is provided wherein the final rolling operation includes processing of a rail blank in a leader pass universal mill stand and in a finishing pass universal mill stand. Both mill stands have horizontal rolls that form two roll passes, one of which is the leader roll pass and the other is a finishing roll pass. The rolls or the entire mill stands are interchanged from a previous location in a mill train to use an unused roll pass at the previous location, thereby doubling the roll life and eliminating the need to manipulate or otherwise handle the rail blank for passes in the mill stands.

10 Claims, 8 Drawing Figures

METHOD FOR ROLLING RAILS

BACKGROUND OF THE INVENTION

This invention relates to a method for producing rails by hot-rolling an elongated workpiece in a rolling mill train, having at least two rolling mill stands, each with two roll-pass openings in a pair of horizontal rolls and a vertical roll for each roll-pass opening. More particularly, the present invention relates to such a method for producing rails in which an unused roll-pass opening at one location in the rolling mill train is used at a different location in the rolling mill train by repositioning at least the horizontal rolls, preferably the entire rolling mill stand, at a different location in a manner such that the bottom of a rail product is rolled at one location by a vertical roll and the top of a rail product at a different location by a vertical roll.

In the past, rails were formed by two general methods of rolling. One method was known as a tongue-in-groove, flat or slab and edging, and the second method was known as diagonal or angular. Combinations of the two methods have been used. The former method has been characterized by the axis of symmetry of the rail coinciding with the pitch line and parallel to the train line of the rolls. In the latter method, the rail was shaped in the first pass of the roughing stand instead of first compressing the workpiece to a smaller size and then forming the section partly through compression and partly through spreading. The process of the second method is one of compressing the workpiece from the beginning to the end. The stages of reducing the workpiece, usually identified as a bloom, include a roughing stage where the bloom undergoes a large amount of working, mainly to reduce the size of the section and elongate the bloom. In an intermediate stage, the cross-sectional shape of the bloom is altered to the form of a rail through a combination of slabbing, forming, edging and a leader pass, depending upon the mill layout. In the finishing stage, a finishing pass completes the formation of the rail.

A so-called Gary method for producing rails involves the use of universal rolling mill stands for the leader and finishing passes. In the leader pass, the workpiece is conducted through a pass opening in a pair of horizontal rolls while a head wheel in the form of a vertical roll contacts the top of the rail. In the finishing pass, the workpiece is conducted through a pass opening in a pair of horizontal rolls while a base wheel, in the form of a vertical roll, engages the bottom of the rail. The mill stand for the leader pass may have two leader roll-pass openings, one at each of the opposite sides of the horizontal rolls with a head wheel associated with each leader pass. In a similar way, the finishing stand may have two finishing passes in the horizontal rolls with a base wheel associated with each finishing pass. The so-called Gary method is described in a paper entitled "Operation and Roll Design of the Gary Roll Mill" by R. W. Dickson, published in the *Iron and Steel Engineer*, January 1953.

In U.S. Pat. No. 3,342,053, there is described a method of producing a rail section in a train of rolling mill stands that includes a universal finishing mill mounted on a turret so that two roll-pass openings can be used by rotating the entire mill stand 180° to reposition an unused roll-pass opening for continued use without changing the rolls. Frequent replacement of the rolls in a mill stand is costly, not only from the standpoint of lost production, but also from the standpoint of the costs for refurbishing and supplying new rolls. To obviate this problem in the past, attempts were made to improve the roll-changing procedure and use one and then the other of the two roll-pass openings when a head wheel or base wheel is used to form part of a roll-pass opening. Roll changing is usually more complicated because at least three, instead of two, rolls must be removed and replaced. It is extremely inefficient and undesirable to substitute a worn roll-pass opening at one end of a pair of rolls for a second and replacement roll-pass opening in the same pair of horizontal rolls. In order to use two roll-pass openings in the same set of rolls at the same location in the mill train after one roll-pass opening is worn, all workpieces must be rotated 180° about their longitudinal axes to orientate the top and bottom surfaces of the rail in the proper relation to the vertical roll of the unused roll gap to continue the rolling operation. Handling of the heated workpieces to meet the requirement for rotation at the final stages of the rolling operation increases the likelihood of damage including bending of the rail flanges. The time needed to rotate the workpieces permits unwanted cooling. If the entire mill stand is rotated 180°, then two mill drives must be used, one at each side of the mill. This will overcome the need for rotating the workpiece, but because the rolls can be driven from only one side of the mill, the initial cost for two mill drives is unacceptable. This is because present-day mills provide a thrust bearing on the journal of each horizontal roll at the operator's side to transfer forces acting in an axial direction to the mill housings. Typically, the thrust bearing is mounted on a smaller diameter journal seat surface than the diameter of the journal surface for the main bearings that support the rolls under the rolling force. This "necking-down" of the horizontal roll journals at the operator's side of the mill usually weakens the roll journals to such an extent that they cannot be driven from the ends of the rolls where thrust bearings are used.

Replacing horizontal rolls having a single roll pass in leader and finishing stands, for example, requires an excessively large roll inventory. The additional cost to disassemble chocks from a worn pair of horizontal rolls with a single roll-pass opening adds materially to the overall expense which can be reduced by one-half by the use of horizontal rolls with two roll passes. While not so limited, the present invention overcomes the shortcomings and disadvantages in prior rolling practices by providing a method for rolling the rails and the like wherein horizontal rolls have two roll-pass openings, each for use at one of two different locations in the mill train. This permits the use of a pair of horizontal rolls as well as their chocks when desired, or even the entire mill stand at two different locations in the mill train. The rolling method of the present invention enhances the use of one or more spare mill stands in condition for readiness at some preselected remote location to the mill train for efficient replacement of a mill stand even though one of two roll-pass openings is worn or otherwise requires replacement.

SUMMARY OF THE INVENTION

It is an object of the present invention to provide a method of hot-rolling elongated workpieces to form a rail by providing two different roll-pass openings in a pair of horizontal rolls for different rolling operations according to a rolling schedule to increase utilization of the rolls before replacement and/or refurbishing.

It is another object of the present invention to provide a method for hot-rolling elongated workpieces to form a rail or the like according to a rolling schedule in a rolling mill train which includes a plurality of rolling mill stands each with two roll-pass openings formed by a vertical roll at the sides of a pair of horizontal rolls to process heated workpieces at only one of two different locations and replacing the roll-pass opening at one location with at least a pair of horizontal rolls after use at a different location to utilize an unused roll-pass opening for continued rolling of heated workpieces.

More particularly, according to the present invention there is provided a method of hot-rolling elongated workpieces to form a rail or the like according to a rolling schedule in a rolling mill train which contains at least two rolling mill stands, each having a pair of horizontal rolls and at least one vertical roll, the method including the steps of providing each of the rolling mill stands with rolls defining two different roll-pass openings having preselected configurations to process a heated workpiece according to a rolling schedule at only one of two different locations in the rolling mill train, the vertical roll and pair of horizontal rolls establishing one of the two different roll-pass openings in each of the rolling mill stands, rolling the heated workpieces in a designated one of the two roll-pass openings in each of the rolling mill stands, replacing at least the horizontal rolls at one location with a pair of horizontal rolls after use at a different location to utilize an unused roll-pass opening at the previous location to process workpieces according to the rolling schedule, and rolling additional heated workpieces in the unused roll-pass opening.

At the operator's side of the mill, a thrust bearing is used on the journal of each of the horizontal rolls to transfer axially-directed roll forces to housings of the mill stands at both of the two locations in the rolling mill train while the opposite ends of the rolls are coupled to a drive. The two different roll-pass openings of each rolling mill stand preferably comprise a leader pass and a finishing pass for producing rails. It is preferred to select universal rolling mills to form the rolling mill stands so that the horizontal rolls with two different roll-pass openings are used with a vertical roll to form a head wheel for one pass opening and a bottom wheel for the other pass opening. Two different vertical rolls may be used for this purpose, although the same vertical roll can be used where desired. A pair of horizontal rolls can be removed from one of the rolling mill stands and placed in a different rolling mill stand at another location or, if desired, the entire mill stand can be removed from one location and placed in the mill train in a different location. To facilitate the replacement of the roll stands, one of at least three rolling mill stands can be held in readiness to thereby provide an unused roll-pass opening at the replacement site in the mill train. Desirably, two of four mill stands are held in readiness to replace both the leader pass stand and finishing pass stand. The unused roll-pass opening is at one end of the roll; while a used roll-pass opening is at the other end of the rolls. Thus, the present invention provides that the horizontal rolls in one of the rolling mill stands are replaced which includes refurbishing of the worn rolls when each of the two pass openings are worn after use at different locations in the rolling mill train.

In its preferred form, the method of the present invention provides that hot elongated workpieces are treated in a rolling mill to form a rail according to a rolling schedule through the use of at least two universal rolling mill stands in a mill train wherein the method includes the steps of hot-rolling a workpiece to a desired configuration for final rolling in at least two universal finishing mills according to a rolling schedule, providing each of the universal rolling mill stands with two different roll-pass openings having preselected configurations to process a heated workpiece according to a rolling schedule at only one preselected location downstream of the location where the aforementioned hot-rolling of a workpiece to a desired configuration takes place, rolling heated workpieces in a designated one of the two roll-pass openings in each of the universal rolling mill stands, replacing at least the horizontal rolls at one location with a pair of horizontal rolls after use at a different location to utilize an unused roll-pass opening at the previous location to process workpieces according to the rolling schedule, and rolling additional heated workpieces in the unused roll-pass opening.

These features and advantages of the present invention as well as others will be more fully understood when the following description of the preferred embodiment of the invention is read in light of the accompanying drawings, in which.

Figure 1:
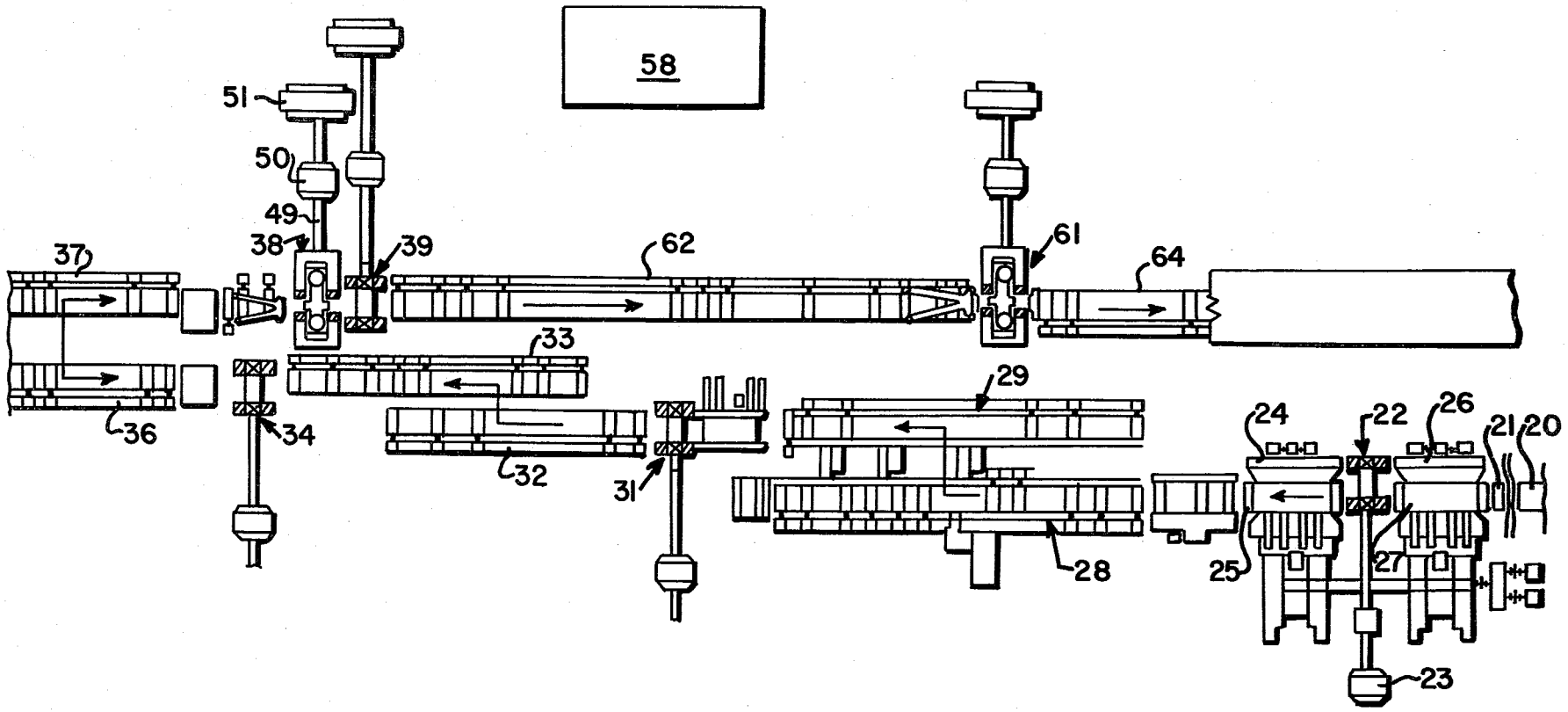
FIG. 1 is a small scale diagrammatic plan view of a rolling mill train to carry out the method of the present invention.

In FIG. 1, there is schematically illustrated a rolling mill train to process a heated workpiece discharged from a furnace 20 after it is heated to a desired elevated temperature for the rolling operations. A heated workpiece, usually called a bloom, is transported from the furnace by a roller table 21 and descaled before initial rolling operations are carried out in a breakdown rolling mill 22. The mill 22 is, per se, well known in the art and includes the usual housings supporting a pair of horizontal rolls coupled by spindles to a drive that includes a drive motor 23. The initial rolling operations on the workpiece are carried out in a number of roll-pass openings in the breakdown mill designed to provide a rail blank which is suitable for intermediate and final rail rolling operations. The schedule of roll passes is designed for the reduction to the cross-sectional area of the bloom as well as changes to the cross-sectional configuration.

Figure 2:
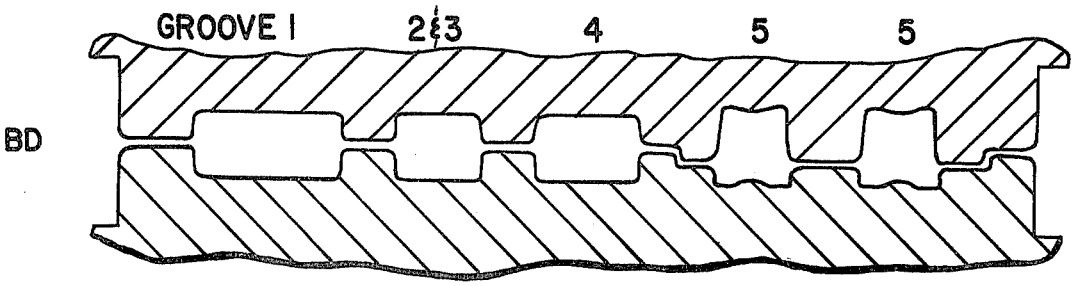
FIG. 2 is an enlarged view of the roll-pass openings in a breakdown rolling mill forming part of a typical rolling schedule to produce rails according to the method of the present invention.

FIG. 2 illustrates a typical schedule of roll passes for the breakdown rolling mill. The initial rolling operation is carried out in groove 1 which is a rectangular roll gap for reducing the cross-sectional size of the bloom. At the delivery side of the breakdown mill, manipulators 24 (FIG. 1) position the workpiece on a mill delivery table 25 for a reversing pass through the breakdown mill using groove 2–3. The bloom may again be passed through this groove by using manipulator 26 to position the bloom on a mill entry table 27. The usual screw-down of the breakdown mill may be operated to change the roll separation for several rolling operations using groove 2–3 to further reduce the cross-sectional size of the bloom. An additional reduction to the cross-sectional size of the bloom is carried out using groove 4 and finally the bloom is rolled using one of the two side-by-side grooves 5 shown in FIG. 2. In this rolling operation, the bloom may be passed through the mill more than once to form concave surfaces at opposite sides of the bloom. The configuration of the roll grooves 5 includes upper and lower crowned surface areas in the body of the rolls.

Figure 3:
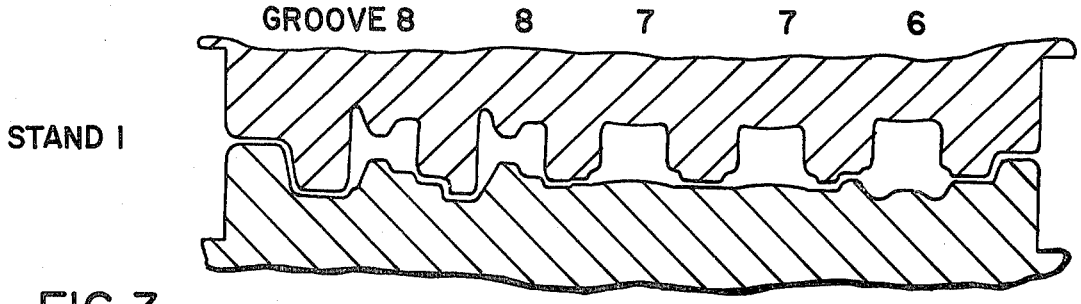
FIGS. 3 and 4 are enlarged views of the roll-pass openings for two successively-arranged rolling mill stands located downstream of the breakdown mill forming an additional part of a typical rolling schedule.
Figure 4:
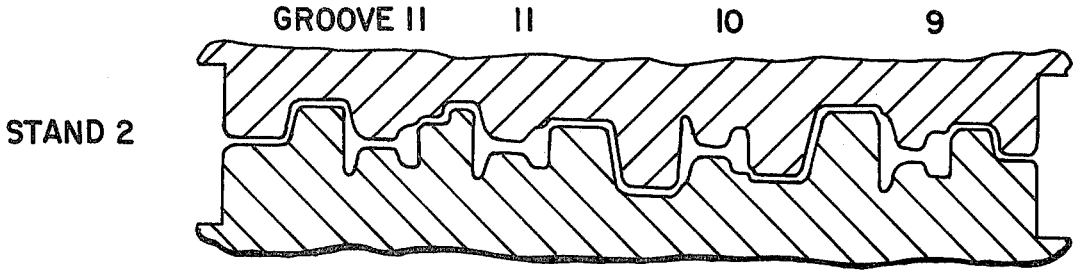

At the conclusion of breakdown rolling operations, the rolled bloom is generally identified as a rail blank which is transferred by a run-out table 28 to a cross-transfer where a roller table 29 directs the workpiece to 2-high rolling mill stand 31. In this mill stand, the rail blank is passed through each of the grooves 6, 7 and 8 shown in FIG. 3 by first feeding the rail blank through groove 6 and then reversing the mill motors for rolling the rail blank in one of the grooves 7 after which the mill motors are again reversed for rolling the rail blank in one of the grooves 8. The hot-rolling operations on the rail blank not only further enhance the metallurgical properties of the workpiece through plastic deformation, but also the deformation of the workpiece in groove 8 brings about an initial forming of a rail section. As clearly apparent from FIG. 3, groove 8 includes protruding rim sections on the upper and lower rolls which deeply penetrate the rail blank, giving form to the rail web section and a rectangular form to a rail head section and the more widely spread rail bottom flange. After the rolling operations have been completed by the use of rolling mill 31, the rail blank is transferred by a run-out table 32 where a side transfer delivers the rail blank to a mill entry table 33 for additional rolling operations using a 2-high rolling mill stand 34. Mill stand 34 includes upper and lower rolls coupled by spindles and a pinion stand to a drive motor for reversing the rotation of the rolls between successive passes of the rail blank through grooves 9–11 which are typically illustrated in FIG. 4. The processing of the rail blank in mill stand 34 is carried out in accordance with the schedule of roll passes by first using groove 9. The height of the web for the rail section is increased as compared with the cross section of the rail blank after the rolling operation in groove 8 of stand 31. At the delivery side of mill stand 34, the workpiece is fed through groove 10 where further reductions to the cross-sectional area of the rail blank are carried out. In this rolling operation, the rail blank is returned to the entry side of the mill stand 34 where it is introduced into one of the grooves 11 for a final rolling operation in stand 34. The grooves 11 are each formed with broad-faced rim sections that shape the rail blank to a roughly-finished form of a rail.

The rail blank is transferred from mill stand 34 by a run-out table 36 and cross-transferred to an entry table 37. The workpiece is advanced by table 37 to the entry side of a universal rolling mill stand 38 having, at the delivery side thereof, an edger mill stand 39 closely adjacent thereto. The present invention provides for processing of a rail blank in the universal rolling mill stand 38 designated as a leader-pass mill stand through the exclusive use of only one of two roll-pass openings in the horizontal rolls. The leader pass is groove 12 in the schedule of roll passes and identified by reference numeral 41 in FIG. 5. A head wheel is formed by a vertical roll 42 which is positioned at one end of the roll bodies of upper and lower horizontal rolls 43 and 44. It is preferred, although not absolutely essential, to use one of the usual two vertical rolls in a universal mill stand to form the head wheel. When viewed from the entry side of the mill stand, as are all the grooves of FIGS. 1–7, the head wheel is formed by the vertical roll at the operator's side of the mill and contacts the top surface of the rail head under a predetermined rolling force. The development of axially-directed thrust forces on the horizontal rolls is resisted by thrust bearings incorporated in the chocks for the horizontal rolls. The universal rolling mill stand 38 may embody a construction of parts that is, per se, well known in the art. One preferred construction for the universal rolling mill stand is shown in U.S. Pat. No. 3,802,242.

Figure 8:
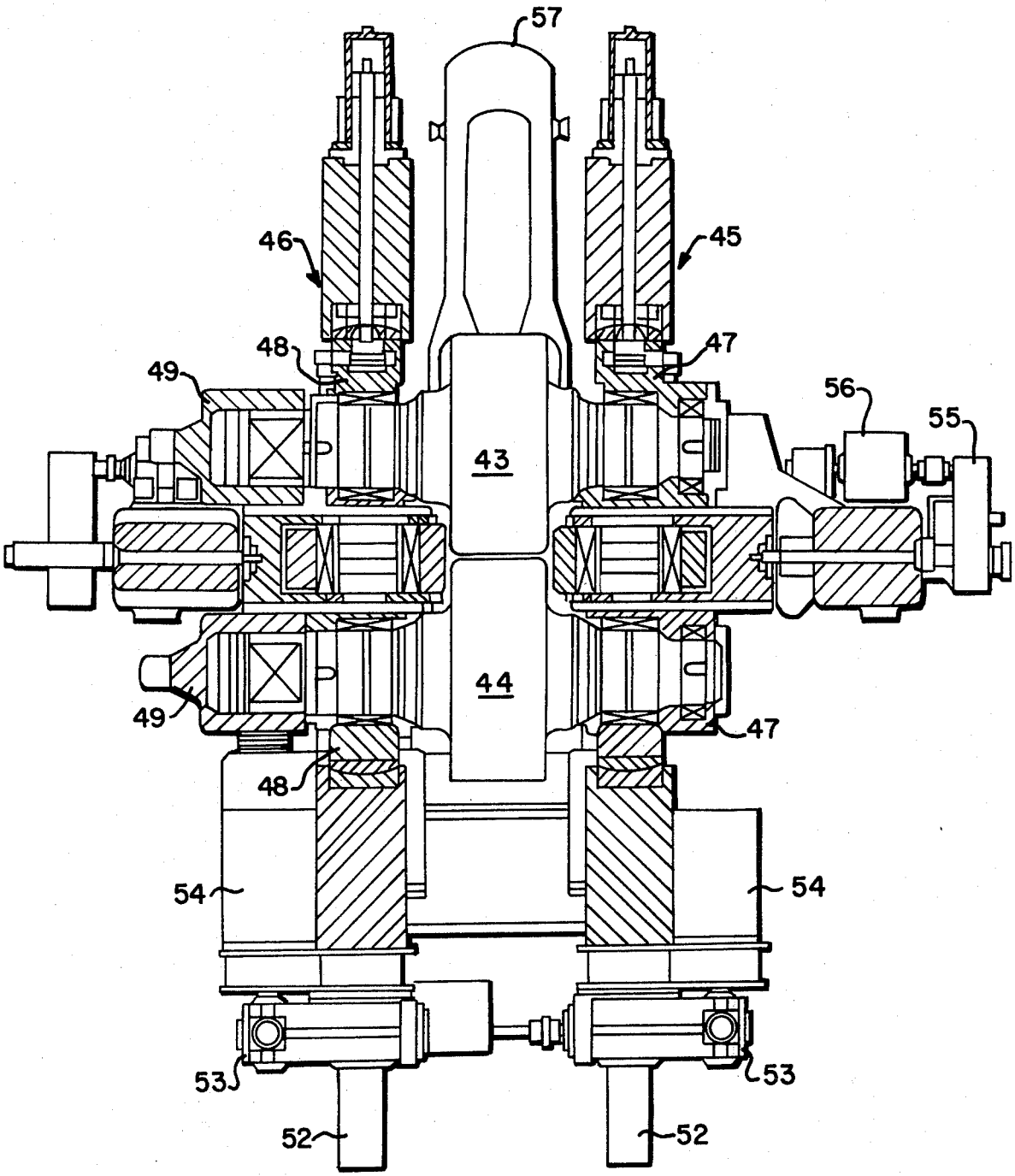
FIG. 8 is an elevational view, in section, of one form of a universal rolling mill stand for carrying out the method of the present invention.

FIG. 8 illustrates the major components of such a universal rolling mill stand wherein the upper and lower horizontal rolls 43 and 44 have journals at their opposite ends for receiving bearings carried in roll chocks that are, in turn, received within the windows of spaced-apart housings 45 and 46. The roll chocks at the operator's side of the mill are indentified by reference numeral 47 and the roll chocks at the drive side of the mill are identified by reference numeral 48. At the drive side of the mill, the journals of rolls 43 and 44 are extended and provided with wobblers each of which receives the end portion of a drive spindle 49. The spindles extend in a generally horizontal direction to a mill drive 50 (FIG. 1) which is coupled to a drive motor 51. The mill housings 45 and 46 may each embody a one-piece construction, per se, well known in the art, with laterally-projecting wing sections that support screw and nut assemblies for adjusting the position of the vertical rolls at the sides of the horizontal rolls. As described above, however, it is preferred to provide the mill housings in the form of three component parts, namely, upper crossheads, lower crossheads and a vertical roll frame which is joined together by spindles. The spindles, identified in FIG. 8 by reference numeral 52, are retained against axial movement in the vertical roll frame and have threaded end portions that engage nuts, each associated with an upper and lower crosshead to position the crossheads and the chocks for the upper and lower rolls engaged therewith relative to the vertical roll frame. The spindles are coupled to screwdown drives 53 that include motors 54. The screw and nut assemblies for adjusting the vertical rolls are coupled to a drive 55 that includes a motor 56. A lift yoke 57 extends from a separator bar between the mill housings for use with a mill crane to lift the mill housing from a foundation support that includes the usual bed plates. It is within the scope of the present invention to change rolls in the stands in the mill train as an alternative to replacing mill stands. Three, but preferably four, universal rolling mill stands of the type just described are provided for a rolling mill installation. One or two of the mill stands will be placed in storage at a designated area such as area 58 shown in FIG. 1. One of the two remaining universal rolling mill stands is used to form leader pass mill stand 38 while the remaining universal rolling mill stand is used to form a finishing pass mill stand identified in FIG. 1 by reference numeral 61. The finishing pass mill stand 61 is located downstream of the leader pass mill stand 38 and the edger mill 39. A run-out table 62 delivers the workpiece from the edger mill 39 for final rolling operation in the finishing mill.

Figure 5:
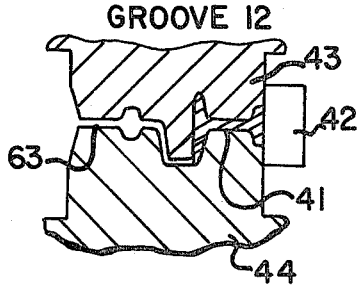
FIG. 5 is an enlarged view of the roll-pass openings in a leader pass rolling mill stand forming an additional roll-pass opening according to a typical rolling schedule.
Figure 6:
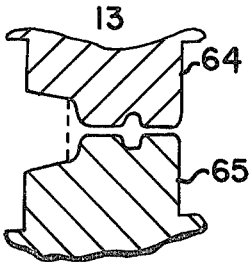
FIG. 6 is an enlarged view of the roll-pass openings in an edger mill stand downstream of the leader pass rolling operation of FIG. 5.
Figure 7:
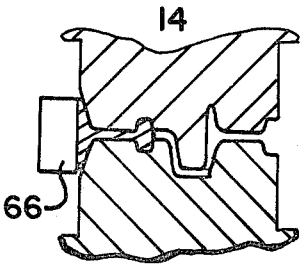
FIG. 7 is an enlarged view of a finishing roll-pass opening in the final rolling mill stand of the mill train according to a typical rolling schedule.

The upper and lower horizontal rolls 43 and 44 in the leader pass mill stand are provided with, in addition to the leader roll-pass opening 41 forming groove 12 in FIG. 5, a finishing roll-pass opening 63. The finishing roll-pass opening 63 extends from a profiled configuration in the body of rolls 43 and 44 to the ends thereof which is opposite the ends of the rolls that cooperate with vertical roll 42. The roll-pass opening 63 is designed to carry out a rolling operation wherein a vertical roll forming a bottom wheel contacts the bottom flange surface of the rail. Thus, roll-pass opening 63 is used in conjunction with a vertical roll to form the finishing roll pass defining a groove 14 in the schedule of roll passes only at the location of the finishing pass stand in the rolling mill train. When rolls 43 and 44 are used in the leader pass mill stand 38, roll opening 63 of these rolls is not used. After a rail blank is processed in the leader pass mill stand, it is immediately thereafter fed into the roll gap formed in edger rolls 64 and 65 of the edger mill stand 39. The operation of the edger mill stand is, per se, well known in the art, where groove 13 in the schedule of roll passes is typically illustrated in FIG. 6. In FIG. 7, the finishing roll pass which is the final roll pass in the schedule of roll passes processes the rail by cooperative engagement with the rail blank by upper and lower rolls 43 and 44, respectively, and a bottom wheel in the form of vertical roll 66.

The present invention provides that the horizontal rolls for the leader pass mill stand and the finishing pass mill stand each has two roll passes, one of which is used when at least the horizontal rolls or the entire mill stand is located at the stated position in the mill train. The unused roll pass is utilized by relocating at least the horizontal rolls or even an entire mill stand immediately in the mill train or after a period of time in storage at the location where worn rolls are replaced. Specifically, for example, if the roll-pass opening used as the leader roll pass in universal mill stand 38 is worn, and at the same time, the finishing mill roll pass in universal mill stand 61 is worn, the horizontal rolls of these two mill stands can be interchanged. The unused leader roll pass in the horizontal rolls of the universal mill stand 61 can then be located in universal mill stand 38 and the horizontal rolls from mill stand 38 are placed in mill stand 61. In this way, both mill stands 38 and 61 are efficiently re-equipped with a desired, unused roll-pass opening which is designed for the specific location of the mill stand in the rolling mill train. When preferred, or desired, the universal mill stand 38 when used for the leader pass rolling operation can be moved from its usual shoe plates and placed on the shoe plates at the finishing mill roll stand location in the mill train. The mill stand can be lifted by a crane or it can be relocated by other means, such as providing wheels on the stand to roll along tracks. At the same time, the universal mill stand 61 can be placed on the shoe plates at the location in the rolling mill train where the leader pass rolling operation is carried out. Moreover, one or both of the universal mill stands 38 and 61 can be removed from the mill train, placed in storage in the area 58 and stored mill stands having unused roll-pass openings suitable for each location can be removed from the storage area and placed on the shoe plates for operation in the rolling mill train. However, the unused mill stands in storage must have an unused or at least a roll-pass opening that is still usable and suitable for use at the particular location where the mill stand is newly situated.

In addition to the doubling of the useful life of a pair of horizontal rolls for the universal mill stands 38 and 61, the method of the present invention eliminates the need for rotating a rail blank before and/or after processing in these mill stands. The finished rail product at the discharge side of the finishing mill stand 61 can always be transferred by a roller table 64 in proper orientation with respect to its web and rail head sections for sawing, cambering and entry onto a cooling bed. Since all rails are transported in the same relative position on the table 64, they are always handled in the same manner without manipulation during post-rolling operations. This minimizes both the equipment required for post-rolling operations and the temperature differences that might otherwise occur from rail-to-rail as they enter a cooling bed. As is well known in the art, the cooling of rails is extremely critical, particularly the cooling from about 1100° F. to ambient temperature. Usually, the cooling is accurately controlled and retarded by placing the rails in closed containers or the like.

The method of the present invention is applicable to the production of rails for the railroad industry as well as other fields, such as cranes and the like. It is to be understood that a rail produced by the present invention may embody any one of a number of desired cross-sectional configurations and weight per unit of length. The particular schedules of roll passes must be selected as necessary and desired for the actual rolling process.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A method of hot-rolling elongated workpieces to form a rail or the like according to a schedule of roll passes in a rolling mill train which includes at least two rolling mill stands each having a pair of horizontal rolls and at least one vertical roll, said method including the steps of:

providing each of said rolling mill stands with rolls defining two different roll-pass openings having preselected configurations to process a heated workpiece according to said schedule at only one of two different preselected locations in the rolling mill train, said vertical roll and a pair of horizontal rolls establishing one of the two different roll-pass openings in each rolling mill stand, rolling heated workpieces in a designated one of the two roll-pass openings in each of the rolling mill stands, replacing at least the horizontal rolls at one location with a pair of horizontal rolls after use at a different location to utilize an unused roll-pass opening at the previous location to process workpieces according to said schedule, and rolling additional heated workpieces in said unused roll-pass opening.

2. The method according to claim 1 including the further steps of using a thrust bearing on the journal of each horizontal roll at the operator's side of the rolling mill train to transfer axially-directed roll forces to housings of said rolling mill stands, and coupling the horizontal rolls in the rolling mill train to a drive at the side of the mill train opposite said operator's side.

3. The method according to claim 1 or 2 wherein said two different roll-pass openings of each rolling mill stand comprises a leader roll-pass opening and a finishing roll-pass opening for producing rails.

4. The method according to claim 1 wherein said rolling mill stands include universal rolling mills.

5. The method according to claim 1 including the further steps of providing at least three of the said rolling mill stands each having two different roll-pass openings to process workpieces at one of two different locations, and storing one of said three rolling mill stands, said step of replacing at least the horizontal rolls being further defined to include replacing a rolling mill stand at one location with the stored rolling mill stand.

6. A method of hot-rolling elongated workpieces to form a rail according to a schedule of roll passes in a rolling mill train which includes at least two universal rolling mill stands, a pair of horizontal rolls and at least one vertical roll, said method including the steps of:

hot-rolling a workpiece to a desired configuration for final rolling in at least two universal finishing mills according to said schedule, providing each of said universal rolling mill stands with two different roll-pass openings having preselected configurations to process a heated workpiece according to said schedule at only one of two different preselected locations downstream in the mill train from the said step of hot-rolling a workpiece to a desired configuration, rolling heated workpieces in a designated one of the two roll-pass openings in each of the universal rolling mill stands, replacing at least the horizontal rolls in a universal rolling mill stand after use at a different location to utilize an unused roll-pass opening at the previous location to process workpieces according to said schedule, and rolling additional heated workpieces in said unused roll-pass opening.

7. The method according to claim 6 including the further step of using an edger mill to process a workpiece at the discharge side of one of said two universal rolling mill stands, and thereafter processing the workpiece in the second of said two universal rolling mill stands in the rolling mill train.

8. The method according to claim 6 or 7 wherein said two different roll-pass openings of each universal rolling mill stand comprise a leader roll-pass opening and a finishing roll-pass opening.

9. The method according to claim 6 wherein said step of replacing at least the horizontal rolls includes replacing a universal rolling mill stand at one location with a universal rolling mill stand after use at a different location to process workpieces according to said schedule.

10. The method according to claim 6 wherein said two different roll-pass openings of each universal rolling mill stand comprises a leader roll pass and a finishing roll pass, and wherein said step of rolling additional heated workpieces includes using a vertical roll of a universal mill to contact the top of a rail workpiece in said leader pass and using a vertical roll of a universal mill to contact the bottom of a rail workpiece in said finishing pass.

* * * * *